US008127676B2

(12) United States Patent
Kerz

(10) Patent No.: US 8,127,676 B2
(45) Date of Patent: Mar. 6, 2012

(54) PRINT CONTROL STRIP AND METHOD OF PREPARING THE SAME

(75) Inventor: Ludo Kerz, Nieder-Olm (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 928 days.

(21) Appl. No.: 11/872,112

(22) Filed: Oct. 15, 2007

(65) Prior Publication Data

US 2008/0087184 A1 Apr. 17, 2008

(30) Foreign Application Priority Data

Oct. 13, 2006 (DE) ..... 10 2006 049 028

(51) Int. Cl.
*B41F 33/00* (2006.01)

(52) U.S. Cl. ..... 101/463.1; 101/485; 101/DIG. 46

(58) Field of Classification Search ..... None
See application file for complete search history.

(56) References Cited

U.S. PATENT DOCUMENTS 4,947,746 A 8/1990 Jeschke et al.
5,460,090 A * 10/1995 Pfeiffer et al. ..... 101/365

FOREIGN PATENT DOCUMENTS

DE 3643721 C2 6/1988

* cited by examiner

*Primary Examiner* — Joshua D Zimmerman
(74) *Attorney, Agent, or Firm* — Laurence A. Greenberg; Werner H. Stemer; Ralph E. Locher

(57) ABSTRACT

A method of preparing a print control strip including at least two process control elements and being adapted to at least a width of at least one used area of at least one original image, includes determining borders of the at least one used area. A state is assigned to every process control element in dependence on if the process control element is located substantially inside the borders. A print control strip is created by using only process control elements that have been assigned a state as being inside the borders.

11 Claims, 1 Drawing Sheet

PRINT CONTROL STRIP AND METHOD OF PREPARING THE SAME

CROSS-REFERENCE TO RELATED APPLICATION

This application claims the priority, under 35 U.S.C. §119, of German Patent Application DE 10 2006 049 028.2, filed Oct. 13, 2006; the prior application is herewith incorporated by reference in its entirety.

BACKGROUND OF THE INVENTION

Field of the Invention

The invention lies in the field of electronic reproduction technology and relates to a print control strip for visual inspection and calibration of a printing process for print substrates, in particular paper sheets. The invention also relates to a method of preparing a print control strip and adapting it to the width of at least one dedicated area of an original image.

Usually, a dot-by-dot or line-by-line rastered exposure of a recording material, for example a printing plate, is carried out through the use of an electronic recording device, also referred to as a plate exposure device or recorder. For that purpose, image data that represent tone values to be recorded, are fed to a raster generator, i.e. a raster image processor (RIP), in which the image data are converted in accordance with a rastering function into control signal values for an exposure beam generated in an exposure unit of the exposure device. In a relative movement between the exposure beam and the printing plate to be exposed, the plate is exposed dot by dot and line by line as the control signal values switch the exposure beam on and off and thus determine which dots, frequently also referred to as pixels, are exposed as parts of the raster dots on the printing plate and which dots are not exposed. The rastering function determines the size of the raster dots in dependence on the tone values to be recorded. When a printing plate is exposed in a plate exposure device, the relative movement is achieved, for example, by attaching the printing plate to a printing plate cylinder and by rotating it below an exposure head including the optical exposure system. This movement defines what is known as the fastscan direction of the exposure on the printing plate. As the printing plate rotates, the exposure head is moved into what is known as the slowscan direction. Alternative, the printing plate may be immovably clamped on the inside of an in-drum exposure device. In that case, the exposure beam is directed to the surface of the printing plate in a line shape through the use of a rotating optical system. The optical system is moved along an axis in the slowscan direction for the exposure of the entire surface.

When the printing plate is exposed, the real tone values or raster dot sizes prepared on the plate deviate from the desired, nominal tone values because every pixel and thus every raster dot is recorded bigger or smaller due to crosstalk and influences of a development process following the exposure. The deviations between the tone values that have actually been prepared and the nominal tone values, which are referred to as dot gains, lead to undesirable changes in the tone values of the reproduction.

Although the dot gains are usually compensated for during the printing plate exposure process in the exposure device, there are always uncertainties resulting from a combination with other process parameters as they occur, for example, during development of the plate or in the printing press.

Changes in the desired tone or color values are the result in an actual printing process using the printing plate that has been prepared.

Print control strips are prepared on the printing plates that are imaged in accordance with a given original image in order to determine deviations of the color or tone values prepared in the printing process. The deviations of the actual printed image that has been prepared from the desired original are determined in an analysis of the printed control strips. Print control strips that are used for that purpose are, for example, Heidelberg 4GS print control strips for the ink zones and Heidelberg PCS 40 Media Wedges for the entire sheet, both prepared by Heidelberger Druckmaschinen AG. In the following description, no difference will be referred to between control strips for individual ink zones and media wedges for the entire sheets. Both will be referred to as print control strips.

Print control strips for the closed-loop control of full tone or raster tone densities in a printed sheet are proposed, for example, in German Patent DE 36 43 721 C2, corresponding to U.S. Pat. No. 4,947,746, the content of which is incorporated by reference herein.

A print control strip includes various process control elements such as measurement fields with prescribed solid tone or halftone densities of a process color or a combination of process colors. Moreover, measurement fields with microlines or fields with microdots may be provided.

The process control elements are marked in such a way that they can be recognized and measured by a suitable measurement device after the printing process. Based on comparisons between the measured process control elements and predetermined desired values, the printing press itself may be readjusted in a following step to better match the actual values with the desired values or other preferences or requirements.

Together with the information on the original image, which today is usually present in digital form, the information on the print control strips is transferred to a RIP and converted into a joint raster bitmap. The original images that have been separated into the process colors are also referred to as color separations. The printing plates are imaged on the basis of the raster image bitmap.

Multiple copies of different images or of the same image may be exposed on one printing plate. For example, a number of different pages may be printed on one print sheet in a subsequent printing process. Those different pages are imaged onto the printing plate.

The print control strips with their process control elements, i.e. their measurement fields (solid tone, halftone, register fields, etc.) are printed onto the print substrate together with those individual pages, i.e. together with the actual print image. The print control strips are always defined for the entire format of a printing press. Yet depending on the actual original image to be reproduced and the print substrate, that format is usually not used up completely. In such a case the width of the print control strip is reduced. That width reduction of the print control strip is carried out in the RIP. In general, the width reduction is done arbitrarily, resulting in measurement fields that are chopped off on the left and right sides. The borders of the chopping operation may be defined manually, or an application program may adapt the chopping operation to the used areas or formats of the original images or sheets. That may be done, for example, in an application program that is also used for imposition with regard to the printing plate. The application program likewise chops off the print control strips in an arbitrary way.

After the printing operation, the printed print control strips are measured with the aid of a measurement system, for example Prinect Axis Control, made by Heidelberger Druckmaschinen AG, Germany. The remainder of the measurement fields that have been cut may cause problems in the known measurement systems, because those measurement fields may be interpreted or recognized incorrectly.

BRIEF SUMMARY OF THE INVENTION

It is accordingly an object of the invention to provide a print control strip and a method of preparing print control strips, which overcome the hereinafore-mentioned disadvantages of the heretofore-known devices and methods of this general type and which provide a reliable and simple way of helping to avoid a chopping of process control elements.

With the foregoing and other objects in view there is provided, in accordance with the invention, a method of preparing a print control strip including at least two process control elements and being adapted to at least a width of at least one used area of at least one original image. The method comprises determining borders of the at least one used area, assigning a state to each process control element in dependence on if the process control element is located substantially inside the borders, and creating a print control strip using only process control elements having been assigned a state as being inside the borders.

Initially, the borders of the at least one used area are determined, and each process control element of the print control strip is assigned a state. This assignment or association is carried out in dependence on the position of the process control element within the print control strip. If the process control element is within the borders of the at least one used area, it is assigned a corresponding state. If it is substantially outside these borders, it is assigned a corresponding state outside the borders. Then a print control strip is prepared that is based exclusively on those process control elements that are substantially within the borders. The remaining process control elements, which would be chopped by the borders, are not used to generate the print control strip.

In accordance with another feature of the invention, the used area of the at least one original image is defined by the borders of an area, which may be an individual copy, a page of the original image, or a width of a complete sheet of the original image. The area may also be a print sheet format that will be used in the subsequent printing process or it may be the format of the printing plate or printing master that is used. Thus it may be possible to print different copies or different pages of a print product onto one print sheet. These different copies or pages must then be exposed on the printing plate in a corresponding way. Between the individual pages or copies, there may be an unprinted gap or a clear space that is not to be used for the printing operation. This may be the case, for example, in the center of a sheet where no printing takes place because in the perfecting mode, for example, contact with a sheet brake is expected in this area. It may also be the case that the width of the subject, i.e. the total width of the original image, deviates from that of the actual print sheet. In this case, it is desirable for the print control strip to extend only over the areas in which the subject will actually be printed rather than over the entire width of the print sheet.

Generally speaking, it may be desirable to prepare process control elements only in an area of a print control strip in which an actual image will be printed. All other areas between individual copies or pages or unprinted areas of the print substrate are to remain free of process control elements. According to the invention, this is achieved in that precisely in these areas, the process control elements are assigned a state in dependence on these borders. Subsequently, only process control elements that are within the individual borders are used to prepare a print control strip. Thus in these areas there will be no chopped process control elements.

In accordance with a further feature of the invention, the states of the process control elements are assigned prior to the preparation of the print control strip and the print control strip is then prepared, taking into account this assignment without these process control elements.

In accordance with an added feature of the invention, the assignment of the process control elements may be carried out by a raster image processor (RIP). The original images to be printed are rastered therein through the use of the RIP. Corresponding information about the print control strips may be transferred to the RIP together with the original images. In accordance with the invention, an additional step or an additional device to assign the process control elements to the individual states is not required.

In accordance with an additional feature of the invention, there is a certain tolerance in the assignment of the process control elements. Process control elements that are substantially within the limited area are considered to be within the borders. If a process control element has an area that is outside the borders up to a length of 0.75 mm, this process control element is assigned as if it was within the borders. A particularly advantageous tolerance has proved to be 0.5 mm.

In accordance with yet another feature of the invention, the instructions of the method described above are provided in a program routine. This program routine should include instructions that recognize the borders of the at least one used area, assign the process control elements in accordance with their state, exclude process control elements that are outside the borders from the preparation of the print control strip and transfer process control elements that have a state within the borders to a raster image processor to prepare the print control strip.

In accordance with yet a further feature of the invention, this program routine may advantageously be provided in the RIP itself. Alternatively, it may be stored together with the print control strip and may be merged with the original image before the original image is transferred to the RIP. In this manner, the preparation of the print control strip may take into account the states of the individual process control elements and take place independently of the RIP that is used.

In accordance with yet an added feature of the invention, in most cases, the original image is stored as what is referred to as a PostScript file or as a Portable Data Format (PDF) file. In order to store the print control strip and the program routine, in particular the program routine may advantageously be provided in the form of an encapsulated PostScript (EPS) or in the form of an XObject within a PDF file. In this manner, it is possible to transfer program codes with the original image within a PDF file to the RIP and execute them. The RIP may then execute the program that is stored in the original image. Since RIPs are capable of executing such programs due to the requirements they have to meet, no adaptations of the program routine to a specific RIP or of a RIP to the routine are required. The method is virtually universal.

If the original image is a PostScript file (PS), the program routine may be provided as a PostScript program part within the original image. A special provision in the form of a specific object is not necessary.

With the objects of the invention in view, there is concomitantly provided a print control strip prepared in accordance with one of the methods described above.

Other features which are considered as characteristic for the invention are set forth in the appended claims.

Although the invention is illustrated and described herein as embodied in a print control strip and a method of preparing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
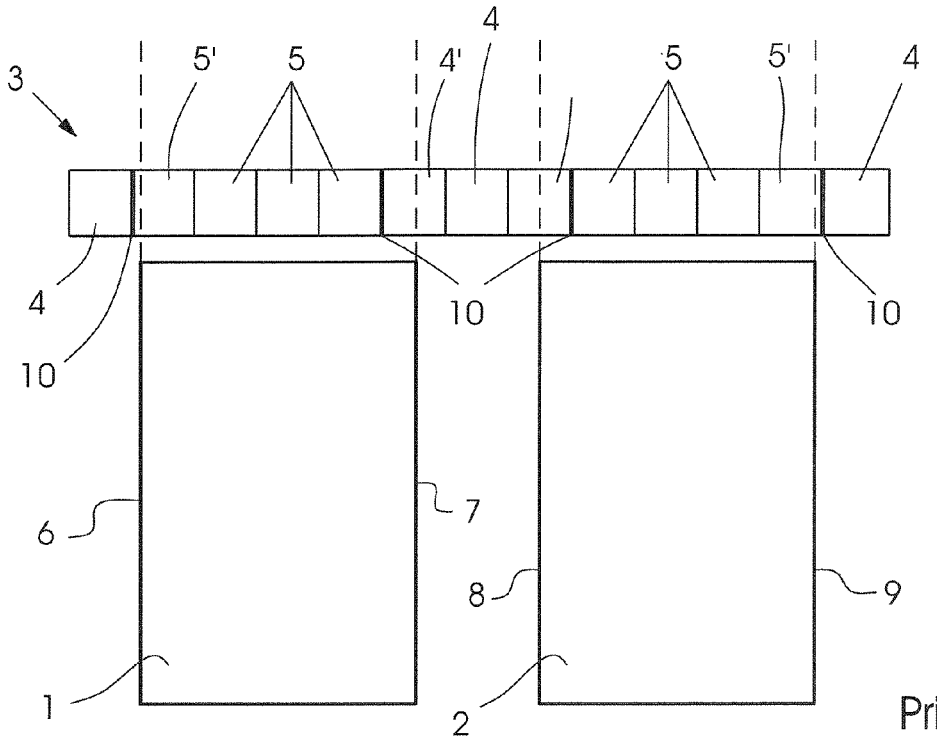
Prior Art Fig.1
FIG. 1 is a diagrammatic plan view of an original image with two pages and print control strips.

Referring now to the figures of the drawings in detail and first, particularly, to FIG. 1 thereof, there are seen two pages 1, 2 which are included in an original image that is otherwise not further illustrated herein. These pages 1, 2 may include a wide variety of objects such as graphics, images, or text. The pages 1 and 2 are examples of used areas. They are not drawn to scale and are for illustration purposes only.

A print control strip 3 is disposed in a free area of the original image. Such a print control strip is usually located at a front edge or rear edge of the original image in relation to the print substrate to be printed.

The print control strip 3 includes measurement fields 4, 4', 5, 5' as process control elements. For reasons of clarity, these measurement fields are enlarged and not drawn to scale. They may be solid tone fields, halftone fields, register fields, or the like.

The pages 1, 2 of the original image are assigned borders 6, 7 and 8, 9. The dashed lines are the continuation of these borders 6, 7, 8, 9 in the area of the print control strip 3.

According to the prior art, the print control strip is chopped during page assembly based on the borders 6, 7 and 8, 9. Such a chopping reduces the print control strip 3 and the process control elements 4' and 5' are chopped and remain only in part. In a subsequent measurement to evaluate the print result, these process control element parts 4' and 5' may cause errors or at least confusion in a measurement system.

For a better understanding, example 1 illustrates a program routine for preparing a print control strip according to the prior art in the form of a pseudocode.

Example 1

```
For all measurement fields of the strip
go to the position of the current measurement field
draw the measurement field
End of loop
```

That program routine is stored as a PostScript within an original image in the PostScript format.

It is a program loop that instructs for all process control elements of the print control strip, i.e. for all measurement fields of the strip to go to the position of the current measurement field, to draw the measurement field, and to prepare the next measurement field in a following execution of the loop.

In that manner, all measurement fields are initially drawn without considering a required chopping due to the used area. In the prior art, the RIP frequently knows where the used area is located, i.e. where the borders 6, 7, 8, 9 of the individual used areas are located. All image data that are outside those borders are not prepared. Thus the chopped fields described with reference to FIG. 1 are prepared.

Figure 2:
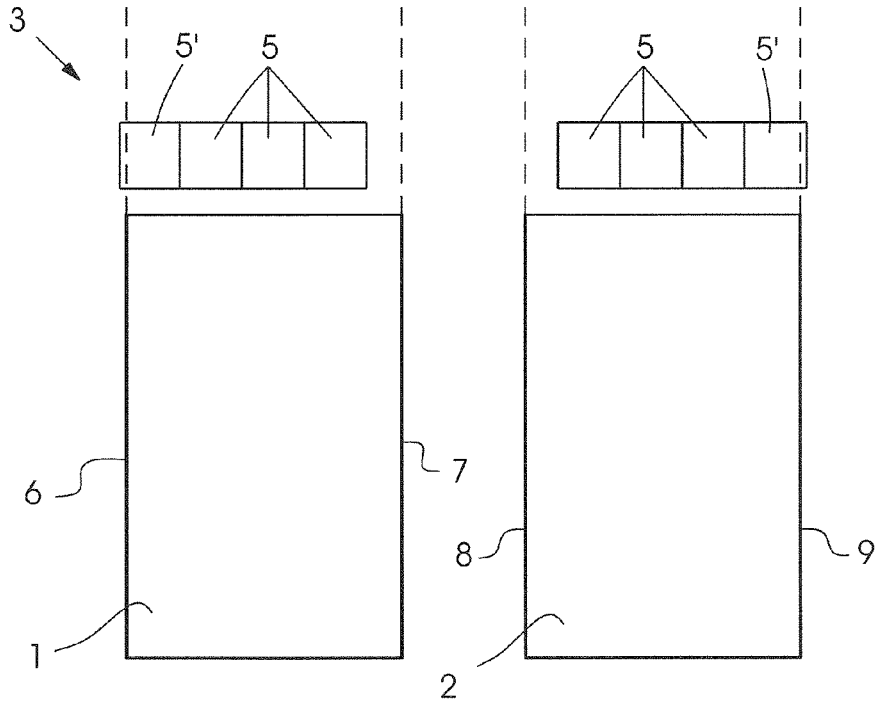
FIG. 2 is a plan view of an original image with pages and a reduced print control strip.

FIG. 2 shows a reduced print control strip 3 that has been cut in accordance with the method of the invention and does not have any chopped off process control elements 4', 5'. As shown in FIG. 1, more than a negligible part of the process control elements 4' is located outside the borders 6, 7, 8, and 9. In accordance with the provisions of the present invention, these process control elements 4' are thus not included when the print control strip 3 is prepared. In contrast, a small part of the process control elements 5' extends beyond the borders 6 and 9. This small part is within the tolerance, which is 0.5 mm, in the given example. Consequently, the process control elements 5' are assigned a state that describes that they are located within the borders 6, 7 and 8, 9. Thus these process control elements 5' are included in the preparation of the print control strip 3. Process control elements 4' protrude beyond the borders 7 and 8 to such an extent that their parts outside the borders are not within the tolerance. Consequently, they are assigned the state of being outside the borders. Thus they will not be used. The print control strip that is prepared in this way does not have any chopped measurement fields or process control elements 4', 5'.

A pseudocode of an exemplary simplified program routine for preparing a print control strip in accordance with a method of the invention is given in Example 2:

Example 2

```
For all measurement fields of the strip
a. go to the position of the current measurement field
   check if the measurement field or parts of the current measurement
   field are in the cut-off area,
   if no:
      draw the measurement field
   if yes:
      leave out the measurement field
End of loop
```

In this context, a loop is likewise to be executed. Initially, the first measurement field, i.e. a first process control element, is targeted. This measurement field is examined to find out whether parts of the process control element or measurement field are inside or outside the borders 6, 7 or 8, 9. Then the measurement field or process control element is assigned a state yes or no. Yes means that the process control element is outside the borders. No means that the process control element is inside the borders. Depending on the associated state, the process control element is drawn if its state is no and it is not drawn if the state is yes. This loop is executed for all process control elements of the print control strip 3.

This program routine may likewise be stored within a PostScript file of the original image. It may also be an embedded program function with in a PDF of an original image. In this case, the RIP opens the embedded program code and executes the process of preparing the print control strip. Suitable tolerances for assigning the states may be stored in a separate area of the program or may be provided directly in the RIP. Based on these tolerances, for the measurement fields 5' assigned the state "no", the measurement field is not located outside the borders 6, 7, 8, 9. A print control strip is generated that includes only complete process control elements 5, 5' located substantially inside the orders 6, 7, 8, 9 of used areas of the original image. Confusion of the electronic measurement system due to chopped measurement fields is avoided.

The invention claimed is:

1. A method of preparing a print control strip including at least two process control elements and being adapted to at least a width of at least one used area of at least one original image, the method comprising the following steps:

determining borders of the at least one used area;

assigning a state to each process control element in dependence on if the process control element is located substantially inside the borders;

creating a print control strip using only process control elements having been assigned a state as being inside the borders; and imaging the print control strip onto a printing plate.

2. The method according to claim 1, which further comprises defining the used area by the borders of at least one region selected from the group consisting of individual copy, individual page, width of subject, print sheet format, and printing master format.

3. The method according to claim 1, which further comprises assigning the states of the process control elements before the print control strip is prepared, and preparing the print control strip without the process control elements.

4. The method according to claim 3, which further comprises assigning the states to the process control elements by a raster image processor.

5. The method according to claim 1, wherein those process control elements that include areas located outside the borders of the used area up to a length of between 0.3 mm and 0.75 mm are assigned a state as being located inside the borders and are included in the creation of the print control strip.

6. The method according to claim 1, wherein those process control elements that include areas located outside the borders of the used area up to a length of 0.5 mm are assigned a state as being located inside the borders and are included in the creation of the print control strip.

7. The method according to claim 1, which further comprises:

providing a program routine including instructions for recognizing the borders of the at least one used area, for assigning a state of being located inside or outside the borders to the process control elements; and transferring data to a raster image processor for using process control elements having been assigned the state of being located inside the borders for a print control strip.

8. The method according to claim 7, which further comprises storing the print control strip within a program routine in the at least one original image.

9. The method according to claim 7, which further comprises storing both the print control strip and instructions in a program routine in the at least one original image.

10. The method according to claim 7, which further comprises embedding the program routines in an EPS or in the form of XObjects in a PDF including the at least one original image.

11. The method according to claim 7, which further comprises storing the program routines directly in the form of PostScript instructions if the at least one original image is provided as a PS file.

* * * * *